US006557644B1

(12) United States Patent
Miller et al.

(10) Patent No.: US 6,557,644 B1
(45) Date of Patent: May 6, 2003

(54) ADJUSTABLE TUBING HANGER ASSEMBLY

(75) Inventors: Michael John Miller, Katy, TX (US); Ralph Anthony Alvarez, Houston, TX (US)

(73) Assignee: Kvaerner Oilfield Products, Inc., Houston, TX (US)

( * ) Notice: Subject to any disclaimer, the term of this patent is extended or adjusted under 35 U.S.C. 154(b) by 0 days.

(21) Appl. No.: 09/919,306

(22) Filed: Jul. 31, 2001

(51) Int. Cl.[7] ..... E21B 43/10

(52) U.S. Cl. ..... 166/382; 166/208; 166/85.1; 166/75.14

(58) Field of Search ..... 166/85.5, 348, 166/360, 382, 181, 208, 241.1, 85.1, 75.14

(56) References Cited

U.S. PATENT DOCUMENTS 3,797,864 A * 3/1974 Hynes et al. ..... 166/208
4,056,272 A * 11/1977 Morrill ..... 285/123.13
4,791,986 A * 12/1988 Vallet ..... 166/379
5,524,710 A * 6/1996 Shinn ..... 166/348
5,653,289 A 8/1997 Hosie et al.
5,878,816 A 3/1999 Lalor et al. ..... 166/348
5,996,695 A * 12/1999 Koleilat et al. ..... 166/382
6,012,519 A * 1/2000 Allen et al. ..... 166/208
6,065,542 A 5/2000 Lalor et al. ..... 166/348
6,328,343 B1 * 12/2001 Hosie et al. ..... 285/123.13

* cited by examiner

*Primary Examiner*—Heather Shackelford
*Assistant Examiner*—Daniel P Stephenson
(74) *Attorney, Agent, or Firm*—Wendy Buskop; Buskop Law Group

(57) ABSTRACT

The invention is an adjustable tubing hanger for suspending a tubular string from a wellhead. The adjustable tubing hanger has an upper body having a seal, a lower body attached to the upper body and the tubular string, a carrier assembly located between the upper body and the lower body providing at least one metal seal for an annulus, and a drive lock assembly attached to the lower body with a tension lock and numerous segments. Each segment has an outer diameter with a grooved profile forming a load bearing interlock for the drive lock assembly. The tension on the tubular string is adjustable depending on adjustments made to the interlock position of the grooved profile.

20 Claims, 3 Drawing Sheets

ADJUSTABLE TUBING HANGER ASSEMBLY

FIELD OF THE INVENTION

The present invention relates to a device which can be used in association with a tubing hanger and to a tubing hanger system which can be adjusted to tension a tubular string or casing string which is connected to a subsea wellhead without the need to pull the tubing hanger.

A tubular string is generally required in offshore petroleum production installations to provide a fluid conduit between a subsea wellhead and a surface wellhead located on an offshore drilling or completion rig. An adjustable tubing hanger is typically used to space out the tubular string between the subsea wellhead and the surface wellhead.

Most commonly in the practice, adjustable mandrel-type tubing hangers have been used but the require that to make the adjustment of the tension on the tubing string, the tubing hanger must be pulled, and then reinstalled for the correct tension on the tubular string.

BACKGROUND OF THE INVENTION

Adjustable tubing hangers are known in the art, see U.S. Pat. Nos. 6,065,542, 5,878,816, and 5,653,289. In U.S. Pat. No. 6,065,542, an adjustable casing hanger has a body suspended within a wellhead that comprises a casing head attached to an offshore rig, and a tubing head connected to the casing head by a suitable connector. A threaded coupling connects the lower end of the casing hanger body to the upper end of a tieback casing string, which in turn is connected to a subsea wellhead. A plurality of grooves is on the outer surface of the upper part of the casing hanger body. The grooves extend from the upper end of the casing hanger body to a point above the lower end of the casing hanger body. The grooves define ridges on the outer diameter surface of the casing hanger body portion, which among other functions helps to center the casing hanger within the wellhead, but are not for tensioning the casing string. Various slots extend below the grooves for communicating fluid between the casing hanger and the wellhead to an annulus port in the wellhead. The adjustability features of this patent have lacked the secure interlocking features which has been long needed. The other two patents are variations on this construction.

The problems with the known systems are that either the whole system has to be pulled out of the wellhead in order to adjust the system or the adjustments are made with complicated mechanisms. A need has long existed to be able to adjust a tubing hanger by simply running in a pin to tighten or loosen tension. A need has long existed for a means to adjust tensioning on a tubular string without having to overpull the entire assembly. A need has long existed for an adjustable tubing hanger assembly which only uses the minimum of overpull for adjusting tension on the tubular string.

The present invention is directed at an adjustable tubing hanger which meets these long felt needs. The invention enables a tubing hanger to be adjusted and readjusted without the need for pulling the entire tubing hanger to adjust tension on the tubular string.

SUMMARY OF THE INVENTION

The present invention relates to an adjustable tubing hanger assembly, a tubing hanger system which includes an adjustable tubing hanger assembly and a method for installing and using an adjustable tubing hanger assembly to adjust tension on the tubular string used in a tubing hanger without the need to raise the tubing hanger or a blow out preventer (BOP) stack.

The present invention contemplates an adjustable tubing hanger assembly for suspending a tubular string from a wellhead comprising: a upper body having a seal; a lower body attached to the upper body and the tubular string; a carrier assembly located between the upper body and the lower body providing at least one metal seal for the annulus; a drive lock assembly attached to the lower body comprising: a tension lock; a plurality of segments, each segment having an outer diameter with a grooved profile forming a load bearing interlock for the drive lock assembly; and wherein the tension on the tubular string is adjustable depending on adjustments made to the interlock position of the grooved profile.

The present invention also relates to an adjustable tubing hanger system for suspending a tubular string from a wellhead comprising: a tubing hanger; an adjustable tubing hanger assembly disposed adjacent the tubing hanger wherein the adjustable tubing hanger assembly comprises: an upper body having a seal; a lower body attached to the upper body; a carrier assembly located between the upper body and lower body providing at least one metal seal for the annulus; a drive lock assembly attached to the lower body comprising a tension lock and a grooved profile forming an interlock with the drive lock assembly; and wherein the tension on the tubular string is adjustable depending on adjustments made to the interlock position of the grooved profile.

The present invention further relates to a method for adjusting and readjusting a tubing hanger having a tubular string connected to a well, comprising: connecting a retrieving tool having a stab in profile to stab into an adjustable tubing hanger assembly; adjusting tension on the tubular string to hold the tubular string vertical; analyzing the alignment of the tubular string and if the alignment requires adjusting, then releasing tension using the tensioning pin; readjusting the tubular string using the retrieving tool; and activating the drive lock to maintain tension on the tubular string.

These and other objects and advantages of the present invention will be made apparent from the following detailed description, with reference to the accompanying drawing.

DETAILED DESCRIPTION OF THE INVENTION

The invention will be described hereafter using the specific example of an adjustable tubing hanger assembly for providing tension on a tubular string, however, this invention also applies to other types of hangers for other types of conduits encountered in gas and oil production installations. For example, the invention encompasses an adjustable casing hanger for a production casing string. Therefore, the following description should be construed to apply to an assembly for any type of tubular hanger used to suspend any corresponding type of tubular string.

Figure 1:
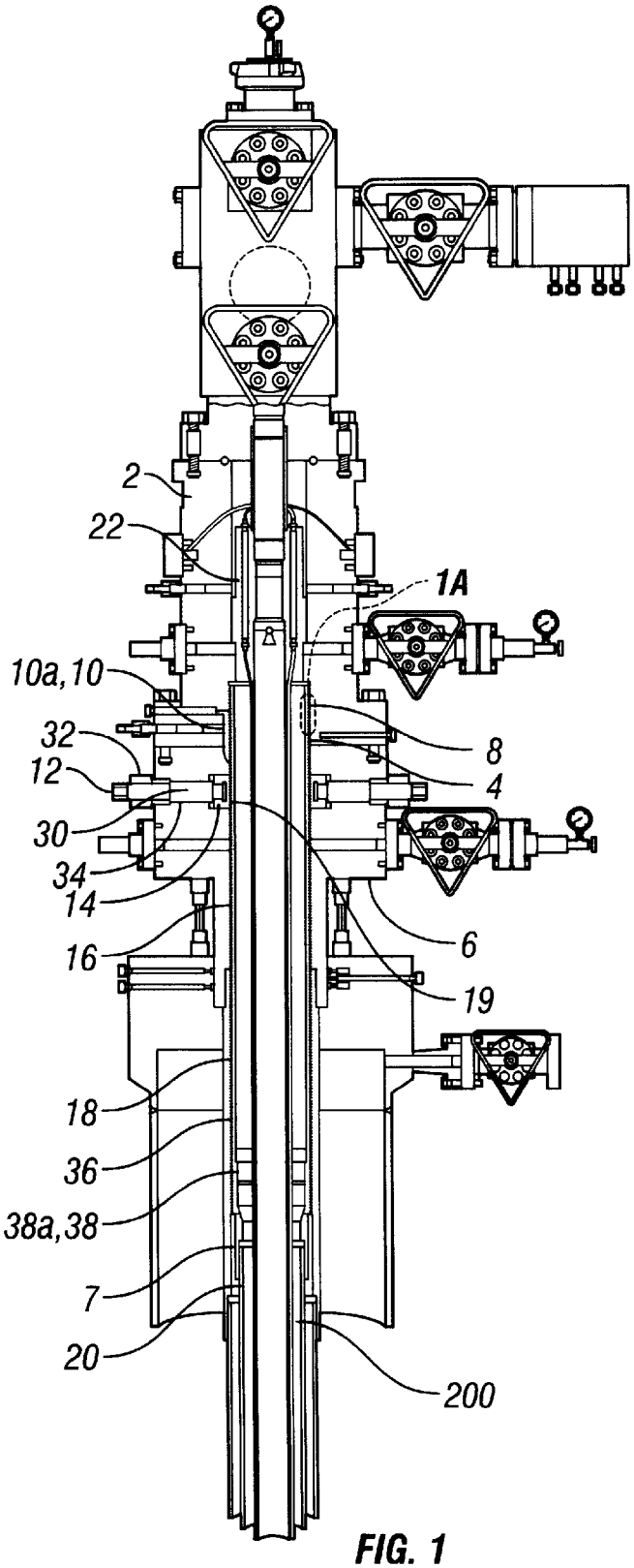
FIG. 1 is a longitudinal cross section of the portion of a tubing hanger with the adjustable tubing hanger assembly installed.

FIG. 1 shows a tubing hanger (22) with an adjustable tubing hanger assembly (16) attached to a portion of the body of the tubing hanger (22). A tubular string (20) enters the tubing hanger (22) from an offshore rig (not shown) and passes through the body of the tubing hanger (22) and into the adjustable tubing hanger assembly (16).

The adjustable tubing hanger assembly (16) has an upper body (2) and a lower body (6). The upper body (2) further has a seal (8) disposed in that upper body (2). A carrier assembly (4) is located between the upper body (2) and lower body (6) providing at least one metal seal (10) to the annulus (7). The upper body (2) and the lower body (6) can be tubular in one embodiment. A plurality of metal to metal seals can be used instead of only one seal (10). A drive lock assembly (12) attaches to the lower body (6) and includes a tension lock (14) and an adjustable tubing hanger assembly (16). The tension lock (14) is preferably perpendicular to the adjustable tubing hanger assembly (16). The adjustable tubing hanger assembly (16) has an inner surface and an outer surface. On the outer surface is a grooved profile (18) having a plurality of teeth and valleys which can engage a second profile (19) of teeth and valleys on the tension lock (14), forming an interlocked connection. The teeth can be a plurality of axially disposed grooves extending from the upper end of the adjustable tubing hanger assembly to the lower end of the adjustable tubing hanger assembly. The amount of teeth and valleys, and the thickness of the teeth will vary in depending on the size of the tension lock, the amount of tension load on the tubular string, the amount of adjustment needed by the consumer, or on the sensitivity of the tension needed to straighten the tubular string. For example, in a preferred embodiment, where the adjustable tubing hanger assembly must handle a tension load of 500,000 pounds, it is contemplated to use from 3–4 teeth per inch, wherein each tooth further has a thickness of between ½ and ¾ inches. These teeth can be any size that the customer desires, certain customers may require adjustment to be within ½ inch, or within ⅓ inch. Teeth could be as large as 2 inches or more depending on user requirements.

Figure 1A:
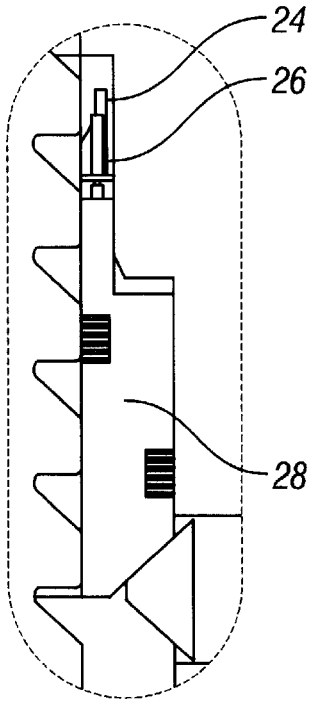
FIG. 1A is an exploded view of the seal.

The seal (8) can be either a metal seal or an elastomeric seal or combinations of both. In one embodiment, as shown in FIG. 1A, the seal (8) can be a metal lip seal (24) which has a wedge (26) and an activating gland (28) adjacent to the wedge (26). The seal (8) may include one or more elastomeric seals disposed on or adjacent, or in grooves of the activating gland (28). In certain cases, seal (8) can be modified to have both primary and secondary sealing for the metal lip seal (24), however, it is within the scope of the invention to have seal (8) only provide primary sealing.

Metal seal (10) is a metal to metal seal which preferably can act as a double acting seal **(10*a*), as shown in FIG. 1**, providing sealing for an annulus and sealing between the upper body and the lower body.

The drive lock assembly (12) further comprises at least one tension pin (30) secured to the tension lock (14) and a tension pin gland (32) for each tension pin. The tension pin gland (32) is secured to the lower body (6) and additional tension packing (34) is disposed around each tension pin (30) to insure a leak tight seal. It is within the scope of the invention to use one tension pin per segment, or one tension per for every other segment.

The adjustable tubing hanger assembly (16) comprises a tooth profile (18). In the preferred embodiment, the tooth profile (18) has a plurality of axially spaced annular grooves on the outer diameter of the adjustable tubing hanger assembly (16) for providing a load bearing surface. The load bearing surface preferably comprises downwardly facing annular grooves (36). In an alternative embodiment, the load bearing surface can be made of one or more segments which are engagable with the tension pins.

The adjustable tubing hanger assembly (16) includes a stab in (38) for adjusting the tooth profile (18) against the tension lock (14). In the most preferred embodiment, the stab in (38) is a quick connecting/quick disconnecting connection **(38*a*), as shown in FIG. 1**.

The tooth profile (18) can comprise a plurality of downwardly facing annular support surfaces on the body, and the adjustable tubing hanger assembly (16) provides at least one generally upwardly facing load shoulder (or tooth) and at least one generally downwardly facing load surface (or valley). The position of the adjustable tubing hanger assembly can be adjusted by moving the teeth and valleys into which the adjustable tubing hanger assembly is interlocked by stabbing in a retrieving tool (200), as shown in FIG. 1, through a quick connect/quick disconnect stab in connection (38) at the lower end of the adjustable tubing hanger assembly.

The adjustable tubing hanger assembly can be connected to the tubular string using a threaded connection which can then be connected to a wellhead, such as a subsea wellhead.

The invention further includes a system involving a tubing hanger, an adjustable tubing hanger assembly and the connector to the well head, which is also shown in FIG. 1.

Figure 2:
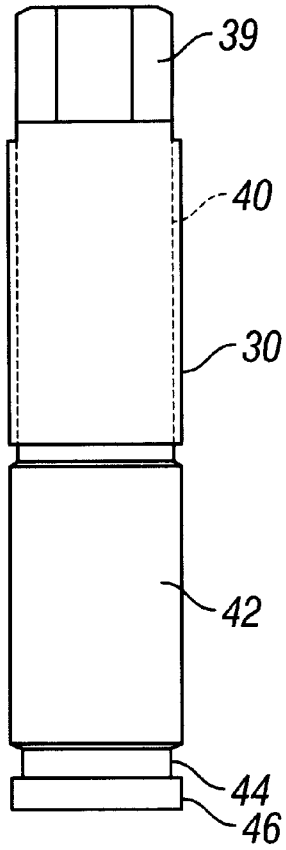
FIG. 2 is a detail of the tension pin.

FIG. 2 shows a detail of the tension pin (30) of the invention. Tension pin (30) consists of, in the preferred embodiment, a body with a hex portion (39), a screwthread (40), a cylindrical member (42) a groove (44) and a head (46). The tension pin (30), in one embodiment, where 500,000 pounds of tension are anticipated, would be between 15 and 17 inches long and have a diameter of between 2 to 3 inches. It should be noted that the hex portion (39) is adjacent to the screwthread (40) which is adjacent to a cylindrical member (such as a solid cylinder of steel) (42), which is adjacent to the groove which does not fully penetrate the pin body, and a head (46) adjacent the groove (44).

Figure 3:
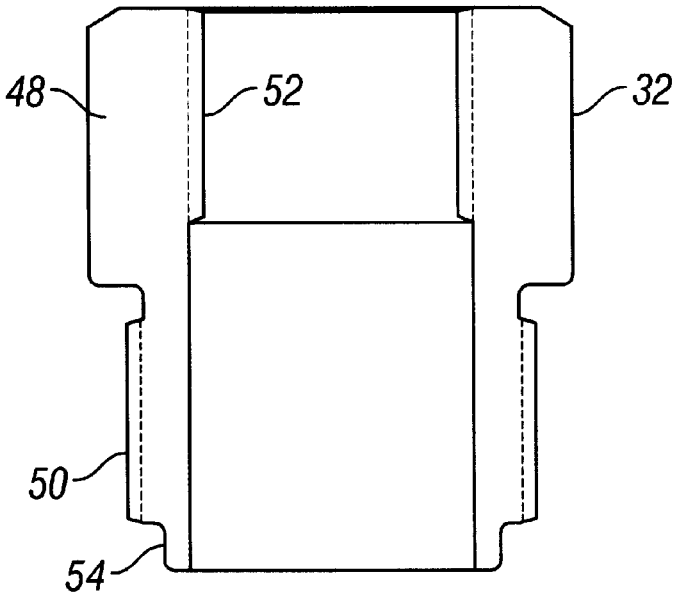
FIG. 3 is a detail of the gland of the present invention.

FIG. 3 shows a detail of the gland (32) of the invention. The gland (32) has a hex head (48) adjacent an external thread (50), and an internal thread (52). The gland is preferably constructed from an alloy steel. The bearing face of the gland (54) is adjacent the external thread (50) and serves to retain the packing.

Figure 4:
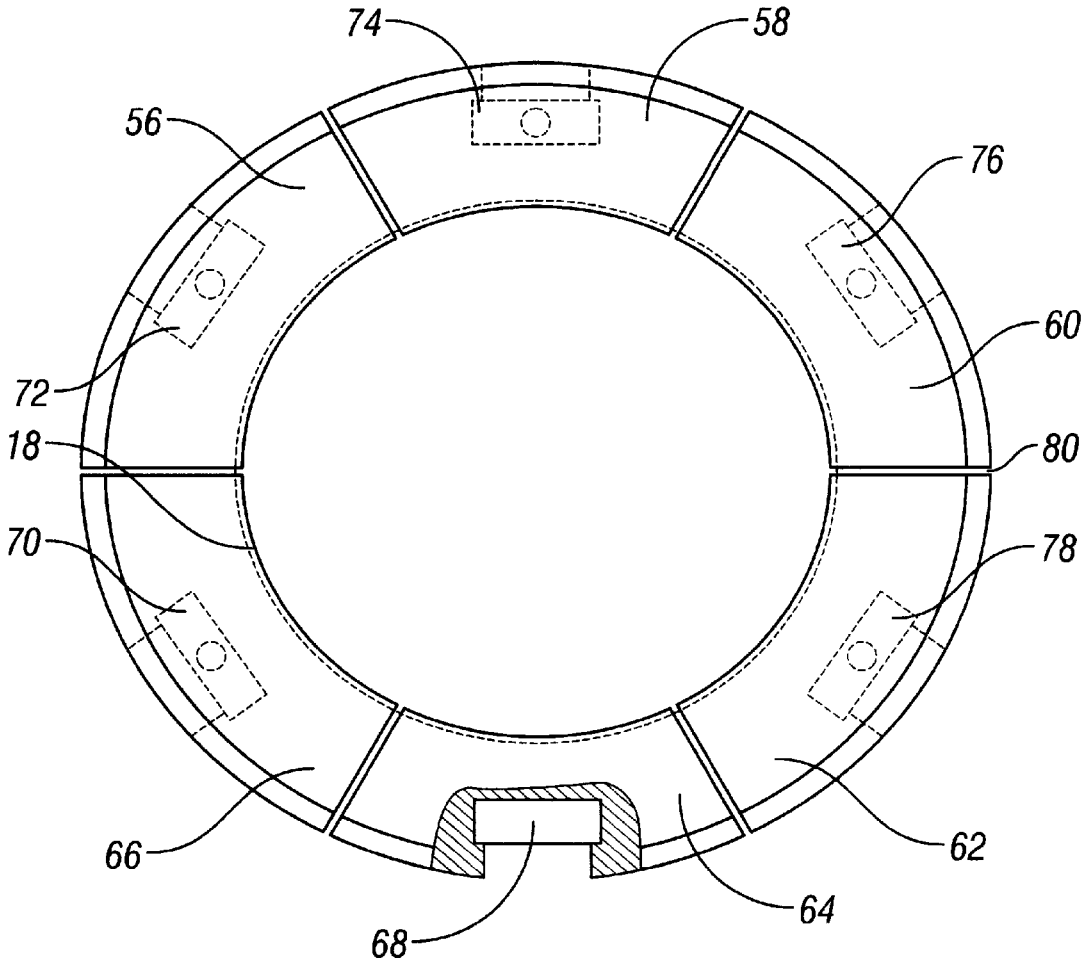
FIG. 4 is a cross section of the tension lock of the present invention.

FIG. 4 provides a cross sectional view of the tension lock (14). Six segmented parts, (56, 58, 60, 62, 64 and 66) are shown in this preferred embodiment. A slot is disposed in each segment, in particular, segment (62) has slot (78), segment (64) has slot (68), segment (66) has slot (70), segment (56) has slot (72), segment (58) has slot (74), and segment (66) has slot (76). Each segment has an inner profile (18) to interlock with the adjustable tubing hanger assembly (16) (not shown in this Figure). In a preferred embodiment, where the tension lock has 6 segments, there are gaps disposed between each segment to facilitate in the adjustment process. One gap is shown as (80) in this Figure. The gap (80) is preferably maintained at a distance of between ⅛ and ¼ inches.

The invention further includes a method of using the adjustable tubing hanger assembly for adjusting and readjusting a tubing hanger having a tubular string connected to a well, such as a subsea well. This method comprises the steps of: connecting a retrieving tool (not shown in the figures) having a stab in profile to stab into an adjustable tubing hanger assembly (16); then adjusting tension on the adjustable tubing hanger assembly (16) to form sufficient tension on the tubular string to hold the tubular string vertical to the wellhead. The next steps involves analyzing the alignment of the tubular string and if it is determined that the tubular string requires adjusting of the alignment, then the next step is releasing tension on the adjustable tubing hanger assembly which releases tension on the tension pin; allowing the user to readjusting the adjustable tubing hanger assembly using the retrieving tool; and activating the drive lock to maintain tension on the tubular string.

In one version of the method of the invention, the retrieving tool can engage a quick connect/quick disconnect connection and stab in less than a minute. A benefit of the invention is that only minimum over pull is needed to enable the retraction of the tension lock to release the tubular string. Finally, the invention may also includes the step of preassembling the adjustable tubing hanger assembly on the surface, or in a facility, then installing the preassembled adjustable tubing hanger assembly on a tubing hanger during tubing hanger installation.

Further features and advantages of the invention will be apparent from the appended claims. It should be recognized that while the present invention has been described in relation to the preferred embodiments, thereof, those skilled in the art may develop a wide variation of structural details without departing form the principles of the invention. Therefore, the appended claims are to be construed to cover all equivalents falling within the true scope and spirit of the invention.

What is claimed is:

1. An adjustable tubing hanger assembly for suspending a tubular string from a wellhead comprising:

a. a upper body having a seal;

b. a lower body attached to the upper body and the tubular string;

c. a carrier assembly located between the upper body and the lower body providing at least one metal seal for an annulus;

d. a drive lock assembly attached to the lower body comprising:

i. a tension lock;

ii. a plurality of segments, each segment having an outer diameter with a grooved profile forming a load bearing interlock for said drive lock assembly; and iii. wherein the tension on the tubular string is adjustable depending on adjustments made to the interlock position of the grooved profile;

e. wherein said seal is a member selected from the group of a metal seal, an elastomeric seal, and combinations thereof; and f. wherein said seal comprises a metal lip seal which further comprises a wedge and an activating gland adjacent said wedge.

2. The assembly of claim 1, wherein said seal further comprises at plurality of elastomeric seals disposed on said activating gland.

3. An adjustable tubing hanger assembly for suspending a tubular string from a wellhead comprising:

a. a upper body having a seal;

b. a lower body attached to the upper body and the tubular string;

c. a carrier assembly located between the upper body and the lower body providing at least one metal seal for an annulus;

d. a drive lock assembly attached to the lower body comprising:

i. a tension lock;

ii. a plurality of segments, each segment having an outer diameter with a grooved profile forming a load bearing interlock for said drive lock assembly;

iii. wherein the tension on the tubular string is adjustable depending on adjustments made to the interlock position of the grooved profile; and e. wherein at least one metal seal is a double acting seal providing sealing for an annulus and sealing between the upper body and the lower body.

4. An adjustable tubing hanger assembly for suspending a tubular string from a wellhead comprising:

a. a upper body having a seal;

b. a lower body attached to the upper body and the tubular string;

c. a carrier assembly located between the upper body and the lower body providing at least one metal seal for an annulus;

d. a drive lock assembly attached to the lower body comprising:

i. a tension lock;

ii. a plurality of segments, each segment having an outer diameter with a grooved profile forming a load bearing interlock for said drive lock assembly;

iii. wherein the tension on the tubular string is adjustable depending on adjustments made to the interlock position of the grooved profile; and e. wherein said drive lock assembly further comprises a plurality of tension pins, with each pin secured to tension lock, a plurality of tension pin glands, each tension pin gland being secured to the lower body, and tension packing disposed around each tension pin.

5. An adjustable tubing hanger assembly for suspending a tubular string from a wellhead comprising:

a. a upper body having a seal;

b. a lower body attached to the upper body and the tubular string;

c. a carrier assembly located between the upper body and the lower body providing at least one metal seal for an annulus;

d. a drive lock assembly attached to the lower body comprising:

i. a tension lock;

ii. a plurality of segments, each segment having an outer diameter with a grooved profile forming a load bearing interlock for said drive lock assembly; and iii. wherein the tension on the tubular string is adjustable depending on adjustments made to the interlock position of the grooved profile;

e. wherein said grooved profile comprises a plurality of axially spaced annular grooves on the outer diameter for providing a load bearing surface; and f. wherein said load bearing surface comprises a plurality of segments each segment having a tension pin.

6. An adjustable tubing hanger assembly for suspending a tubular string from a wellhead comprising:

a. a upper body having a seal;

b. a lower body attached to the upper body and the tubular string;

c. a carrier assembly located between the upper body and the lower body providing at least one metal seal for an annulus;

d. a drive lock assembly attached to the lower body comprising:

i. a tension lock;

ii. a plurality of segments, each segment having an outer diameter with a grooved profile forming a load bearing interlock for said drive lock assembly;

iii. wherein the tension on the tubular string is adjustable depending on adjustments made to the interlock position of the grooved profile; and e. a stab in for adjusting said grooved profile against tension lock.

7. The assembly of claim 6, wherein said stab in is a quick connecting/quick disconnecting connection.

8. An adjustable tubing hanger assembly for suspending a tubular string from a wellhead comprising:

a. a upper body having a seal;

b. a lower body attached to the upper body and the tubular string;

c. a carrier assembly located between the upper body and the lower body providing at least one metal seal for an annulus;

d. a drive lock assembly attached to the lower body comprising:

i. a tension lock;

ii. a plurality of segments, each segment having an outer diameter with a grooved profile forming a load bearing interlock for said drive lock assembly;

iii. wherein the tension on the tubular string is adjustable depending on adjustments made to the interlock position of the grooved profile; and e. wherein said tension lock comprises a plurality of slots each slot for receiving a tension pin.

9. The assembly of claim 8, herein each tension pin comprises a head which engages a slot disposed within said tension lock.

10. An adjustable tubing hanger system for suspending a tubular string from a wellhead comprising:

a. a tubing hanger;

b. an adjustable tubing hanger assembly disposed adjacent the tubing hanger wherein said adjustable tubing hanger assembly comprises: an upper body having a seal; a lower body attached to the upper body; a carrier assembly located between the upper body and lower body providing at least one metal seal for an annulus; a drive lock assembly attached to the lower body comprising a tension lock and a grooved profile forming an interlock with said drive lock assembly;

c. wherein the tension on the tubular string is adjustable depending on adjustments made to the interlock position of the grooved profile; and d. wherein said seal comprises a metal lip seal which further comprises a wedge and an activating gland adjacent said wedge.

11. The system of claim 10, wherein said seal further comprises at plurality of elastomeric seals disposed on said activating gland.

12. An adjustable tubing hanger system for suspending a tubular string from a wellhead comprising:

a. a tubing hanger;

b. an adjustable tubing hanger assembly disposed adjacent the tubing hanger wherein said adjustable tubing hanger assembly comprises: an upper body having a seal; a lower body attached to the upper body; a carrier assembly located between the upper body and lower body providing at least one metal seal for an annulus; a drive lock assembly attached to the lower body comprising a tension lock and a grooved profile forming an interlock with said drive lock assembly;

c. wherein the tension on the tubular string is adjustable depending on adjustments made to the interlock position of the grooved profile; and d. wherein at least one metal seal is a double acting seal providing sealing for an annulus and sealing between the upper body and the lower body.

13. An adjustable tubing hanger system for suspending a tubular string from a wellhead comprising:

a. a tubing hanger;

b. an adjustable tubing hanger assembly disposed adjacent the tubing hanger wherein said adjustable tubing hanger assembly comprises: an upper body having a seal; a lower body attached to the upper body; a carrier assembly located between the upper body and lower body providing at least one metal seal for an annulus; a drive lock assembly attached to the lower body comprising a tension lock and a grooved profile forming an interlock with said drive lock assembly;

c. wherein the tension on the tubular string is adjustable depending on adjustments made to the interlock position of the grooved profile; and d. wherein said drive lock assembly further comprises a plurality of tension pins secured to said tension lock; and a plurality of tension pin glands secured to lower body, and tension packing disposed around each tension pin.

14. An adjustable tubing hanger system for suspending a tubular string from a wellhead comprising:

a. a tubing hanger;

b. an adjustable tubing hanger assembly disposed adjacent the tubing hanger wherein said adjustable tubing hanger assembly comprises: an upper body having a seal; a lower body attached to the upper body; a carrier assembly located between the upper body and lower body providing at least one metal seal for an annulus; a drive lock assembly attached to the lower body comprising a tension lock and a grooved profile forming an interlock with said drive lock assembly;

c. wherein the tension on the tubular string is adjustable depending on adjustments made to the interlock position of the grooved profile;

d. wherein said grooved profile comprises a plurality of axially spaced annular grooves on the outer diameter for providing a load bearing surface; and e. wherein said load bearing surface comprises a plurality of segments, each of which is engagable with a tension pin.

15. An adjustable tubing hanger system for suspending a tubular string from a wellhead comprising:

a. a tubing hanger;

b. an adjustable tubing hanger assembly disposed adjacent the tubing hanger wherein said adjustable tubing hanger assembly comprises: an upper body having a seal; a lower body attached to the upper body; a carrier assembly located between the upper body and lower body providing at least one metal seal for an annulus;

a drive lock assembly attached to the lower body comprising a tension lock and a grooved profile forming an interlock with said drive lock assembly;

c. wherein the tension on the tubular string is adjustable depending on adjustments made to the interlock position of the grooved profile; and d. a stab in for adjusting grooved profile against tension lock.

16. The system of claim 15, wherein said stab in is a quick connecting quick disconnecting connection.

17. A method for adjusting and readjusting a tubing hanger having a tubular string connected to a well, comprising:

connecting a retrieving tool having a stab in profile to stab into an adjustable tubing hanger assembly;

adjusting tension on the tubular string to hold the tubular string vertical;

analyzing the alignment of the tubular string and if the alignment requires adjusting, then releasing tension using the tensioning pin;

readjusting the. tubular string using the retrieving tool; and activating the drive lock to maintain tension on the tubular string.

18. The method of claim 17, wherein said retrieving tool engages said stab in in less than a minute.

19. The method of claim 17, wherein only minimum overpull is required to enable the retraction of the tension lock to release the tubular string.

20. The method of claim 17, further comprising the step preassembling the adjustable tubing hanger assembly and installing said preassembled tubing hanger assembly prior to installing the tubing hanger.

* * * * *